US007841694B2

(12) United States Patent
Sugiyama et al.

(10) Patent No.: US 7,841,694 B2
(45) Date of Patent: Nov. 30, 2010

(54) INKJET PRINTER AND PURGING METHOD

(75) Inventors: Wataru Sugiyama, Aichi-ken (JP); Noritsugu Ito, Tokoname (JP); Naokazu Tanahashi, Nagoya (JP); Shingo Ito, Kasugai (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 533 days.

(21) Appl. No.: 12/001,743

(22) Filed: Dec. 12, 2007

(65) Prior Publication Data

US 2008/0143778 A1 Jun. 19, 2008

(30) Foreign Application Priority Data

Dec. 14, 2006 (JP) ..... 2006-337254

(51) Int. Cl.
*B41J 2/165* (2006.01)

(52) U.S. Cl. ..... 347/32

(58) Field of Classification Search ..... 347/22, 347/29, 32

See application file for complete search history.

(56) References Cited

U.S. PATENT DOCUMENTS

| | | | | |
|---|---|---|---|---|
| 6,010,203 | A | 1/2000 | Muraki | |
| 6,189,997 | B1 | 2/2001 | Kanome et al. | |
| 7,377,616 | B2 * | 5/2008 | Sakurai | 347/29 |
| 7,401,892 | B2 * | 7/2008 | Ha et al. | 347/32 |
| 2007/0296754 | A1 * | 12/2007 | Hiraki et al. | 347/30 |

FOREIGN PATENT DOCUMENTS

| | | |
|---|---|---|
| JP | 3093548 | 4/1991 |
| JP | 8072265 | 3/1996 |
| JP | 11138831 | 5/1999 |
| JP | 2003094673 | 4/2003 |
| JP | 2004305978 | 11/2004 |
| JP | 2005096125 | 4/2005 |

* cited by examiner

*Primary Examiner*—An H Do
(74) *Attorney, Agent, or Firm*—Frommer Lawrence & Haug LLP

(57) ABSTRACT

A first detaching step including (1) moving a nozzle cap from a position, where a sealing surface of the nozzle cap is entirely in contact with a nozzle surface of a recording head, to a first state, where a first end of the sealing surface is separated by a minute distance from the nozzle surface and a second end of the sealing surface is separated from the nozzle cap by a first distance, and (2) maintaining the nozzle cap in the first state. A second detaching step including (1) moving the nozzle cap from the first state to a second state, where the first end of the sealing surface is separated from the nozzle surface by a second distance and the second end is separated from the nozzle surface by a distance greater than the first distance, and (2) maintaining the nozzle cap in the second state.

12 Claims, 11 Drawing Sheets

VACUUM PURGING OPERATION

INKJET PRINTER AND PURGING METHOD

The present application claims priority from Japanese Patent Application Publication No. JP-2006-337254, which was filed on Dec. 14, 2006, the disclosure of which is incorporated herein by reference in its entirety.

BACKGROUND OF THE INVENTION

1. Field of the Invention

The present invention relates to an inkjet printer configured to eject very small ink droplets from a nozzle onto a recording medium, such as a recording sheet, so as to form an image on the recording medium.

2. Description of the Related Art

Inkjet printers are designed to eject ink from a nozzle of a recording head so as to form an image on a recording sheet. Thus, if air bubbles or foreign materials clog the nozzle, for example, the nozzle cannot normally eject the ink and an image cannot be formed on the recording sheet. Similarly, if the water content of the ink in the nozzle evaporates, thereby excessively increasing the ink viscosity so as to clog the nozzle, the nozzle may be prevented from normally ejecting the ink and an image cannot be formed on the recording sheet.

To avoid such a situation, an inkjet printer as disclosed in Japanese Unexamined Patent Application Publication No. 2003-94673, for example, executes a vacuum purging operation for exhausting air from a nozzle cap using a suction pump, with the nozzle cap covering a nozzle, to thereby suck ink from the nozzle to remove air bubbles or materials clogging the nozzle.

Then, after the vacuum purging operation, the nozzle cap is moved off the nozzle surface to separate residual ink on the nozzle surface from residual ink in the nozzle cap.

When the nozzle cap is moved off the nozzle surface, an ink bridge (i.e., ink that forms a bridge from the nozzle cap to the nozzle surface) is produced. At this time, if the ink bridge is cut while the nozzle cap is moved, as in the invention disclosed in Japanese Unexamined Patent Application Publication No. 2003-94673, it is uncertain whether the ink bridge will be cut on the nozzle surface side or the nozzle cap side. The ink bridge might be cut on the nozzle cap side according to the circumstances, with the result that a large amount of ink containing air bubbles or foreign materials remains on the nozzle surface.

In view of the above problems, it is an object of the present invention to avoid, at the time of a vacuum purging operation, such a situation in which a large amount of ink containing air bubbles or foreign materials remain on a nozzle surface.

SUMMARY OF THE INVENTION

An inkjet printer including (1) a recording head including a nozzle surface with nozzles for ejecting ink, (2) a nozzle cap having a sealing surface that comes into contact with the nozzle surface of the recording head, (3) a cap actuator that operates to moves the nozzle cap both toward and away from the nozzle surface, (4) a controller that controls the operation of the cap actuator, and (5) a suction pump that operates to decrease an internal pressure of the nozzle cap when the nozzles are covered with the nozzle cap. Wherein the controller executes a first detaching step and a second detaching step. Wherein the first detaching step includes (1) moving the nozzle cap from a starting state, where the sealing surface is entirely in contact with the nozzle surface, to a first state, where a first end of the sealing surface is either in physical contact with or separated by a minute distance from the nozzle surface and a second end of the sealing surface is separated from the nozzle surface by a first predetermined distance, and (2) maintaining the nozzle cap in the first state for a first predetermined time. Wherein the second detaching step includes (1) moving the nozzle cap from the first state to a second state, where the first end of the sealing surface is separated from the nozzle surface by a second predetermined distance which is greater than the minute distance and the second end is separated from the nozzle surface by a distance greater than the first predetermined distance, and (2) maintaining the nozzle cap in the second state for a second predetermined time. Wherein the minute distance is defined as any distance that can indefinitely sustain an ink bridge between the first end of the sealing surface and the nozzle surface.

A purging method for an inkjet printer including (1) covering a nozzle surface of a recording head of an inkjet printer with a sealing surface of a nozzle cap, (2) decreasing an internal pressure of the nozzle cap with a suction pump, (3) a first detaching step, and (4) a second detaching step. Wherein the first detaching step includes (1) moving the nozzle cap from a starting state, where the sealing surface is entirely in contact with the nozzle surface, to a first state, where a first end of the sealing surface is either in physical contact with or separated by a minute distance from the nozzle surface and a second end of the sealing surface is separated from the nozzle surface by a first predetermined distance, and (2) maintaining the nozzle cap in the first state for a first predetermined time. Wherein the second detaching step includes (1) moving the nozzle cap from the first state to a second state, where the first end of the sealing surface is separated from the nozzle surface by a second predetermined distance which is greater than the minute distance and the second end is separated from the nozzle surface by a distance greater than the first predetermined distance, and (2) maintaining the nozzle cap in the second state for a second predetermined time. Wherein the minute distance is defined as any distance that can indefinitely sustain an ink bridge between the first end of the sealing surface and the nozzle surface.

DESCRIPTION OF THE EMBODIMENTS

Figure 1:
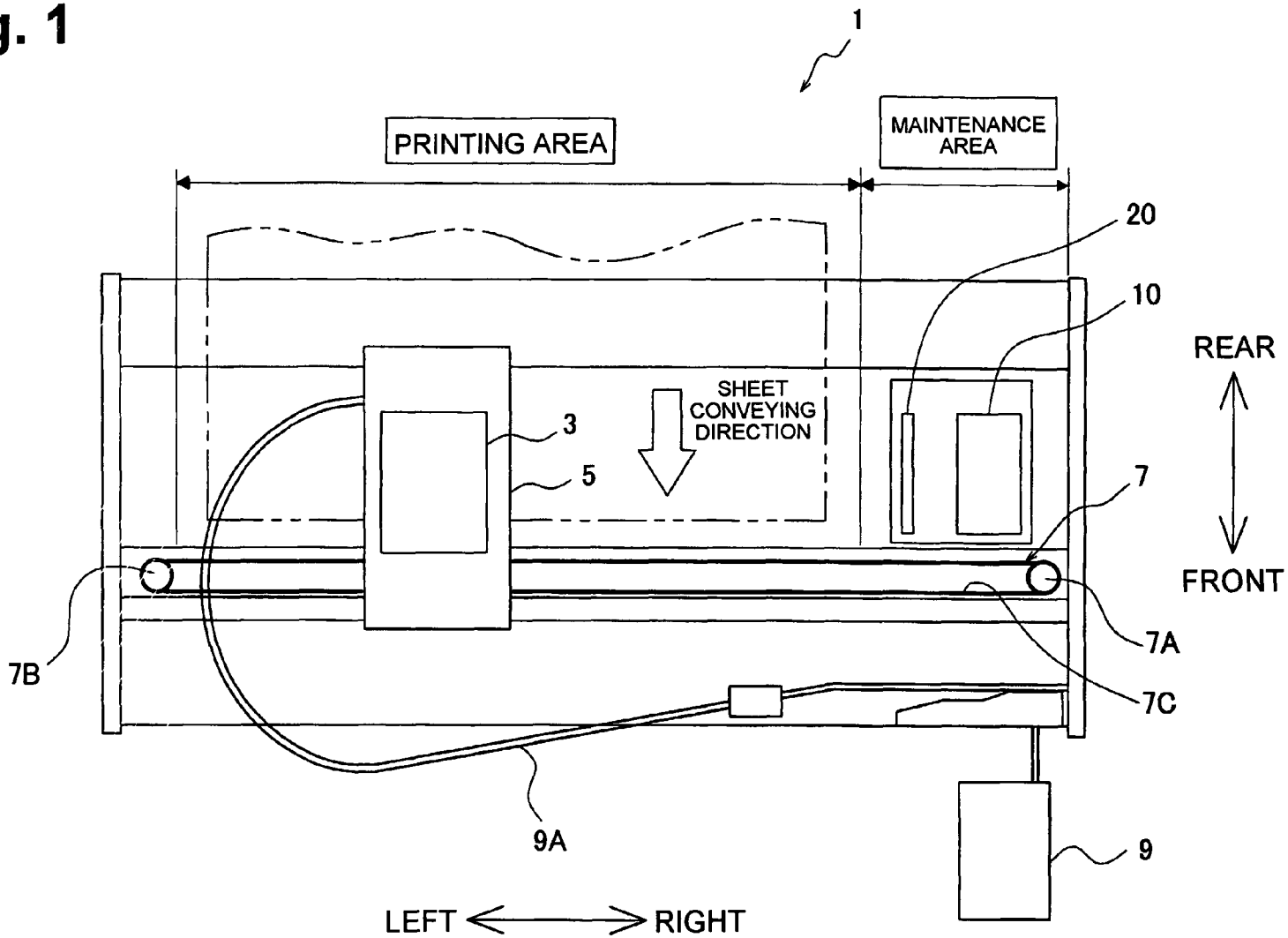
FIG. 1 is a schematic diagram of a main part of an inkjet printer (printer engine unit) according to an embodiment of the present invention.

Referring now to the drawings, the present invention will be described in detail on the basis of exemplary embodiments.

1. Schematic Configuration of Printer Engine Unit 1

The inkjet printer engine unit 1 serves as an image formation unit that ejects very small ink droplets onto a recording medium, such as a recording sheet (hereinafter referred to as "sheet"), to form an image on the recording medium.

As shown in FIG. 1, the printer engine unit 1 of this embodiment includes the recording head 3 for ejecting ink to a sheet, a carriage 5 which incorporates the recording head 3, a scanning mechanism 7 for moving the carriage 5 from side to side in a main scanning direction (lateral direction of the sheet), and an ink tank 9 filled with ink to be supplied to the recording head 3. Here, the main scanning direction (left/right direction in FIG. 1) means a direction orthogonal to a sheet conveying direction and parallel to a recording surface of the sheet.

Figure 3:
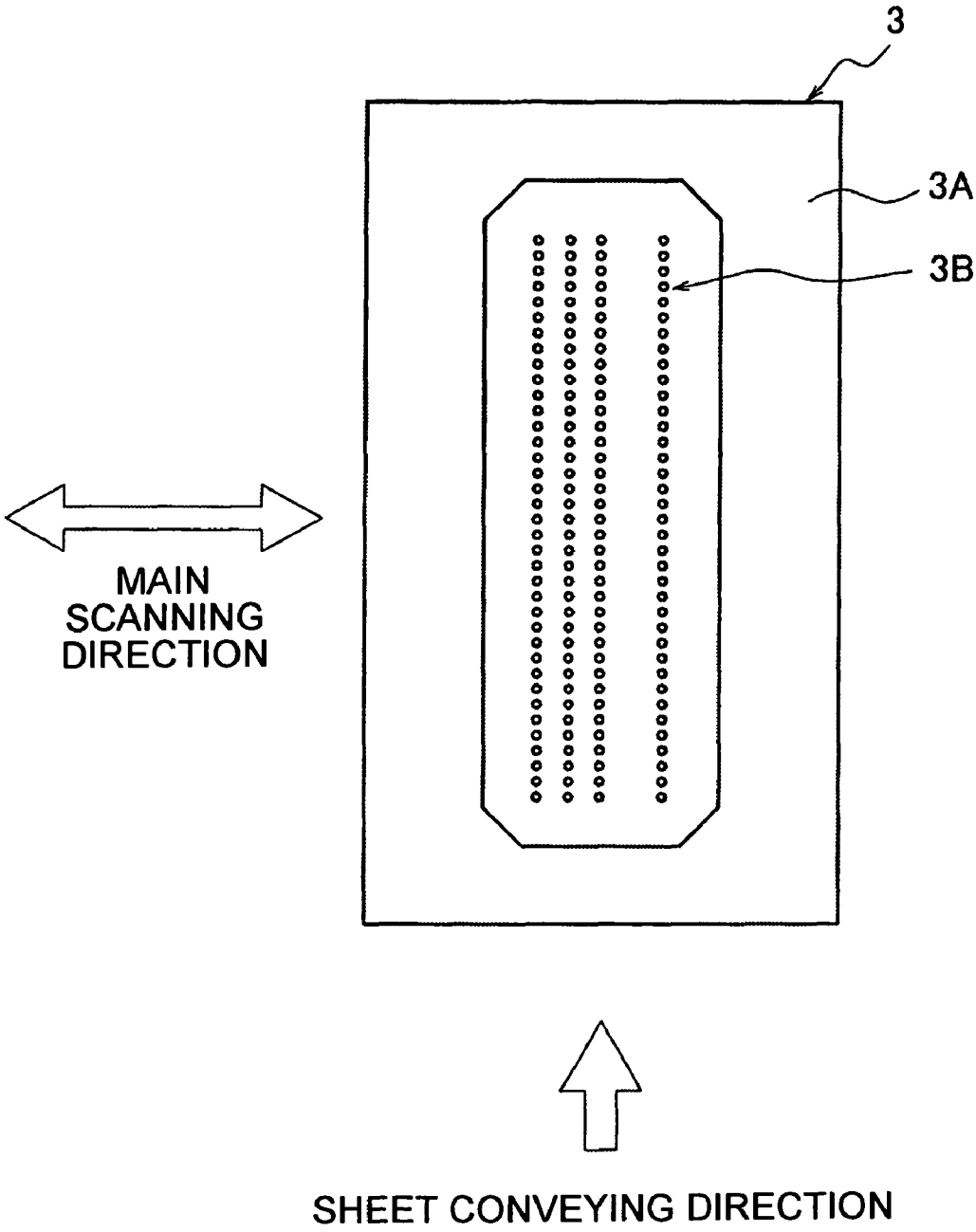
FIG. 3 shows a recording head according to the embodiment of the present invention as viewed from a nozzle (ejecting nozzle) side.

As shown in FIG. 3, the recording head 3 has a number of nozzles 3B opening to a nozzle surface 3A that is opposed to the sheet. The nozzles 3B eject ink, in the form of very small droplets, onto the sheet. An ink ejecting unit (in this embodiment, piezoelectric element) is incorporated upstream of the nozzles 3B in the recording head 3 in an ink flow direction. The ink ejecting unit ejects ink by utilizing deformation of the piezoelectric element or a volume change of air bubbles due to a heat generating resistor. In this embodiment, the nozzle surface 3A and the nozzles 3B are set downward, and the sheet is conveyed toward a lower portion of the recording head 3.

As shown in FIG. 1, the scanning mechanism 7 is composed of a driving pulley 7A provided at one end in the main scanning direction, a driven pulley 7B provided at the other end in the main scanning direction, and an endless belt 7C stretched over the pulleys 7A and 7B. The carriage 5 is fixed to the endless belt 7C. Thus, the endless belt 7C is moved by rotation of the driving pulley 7A, and the carriage 5 is moved in the main scanning direction by the endless belt 7C.

Figure 2:
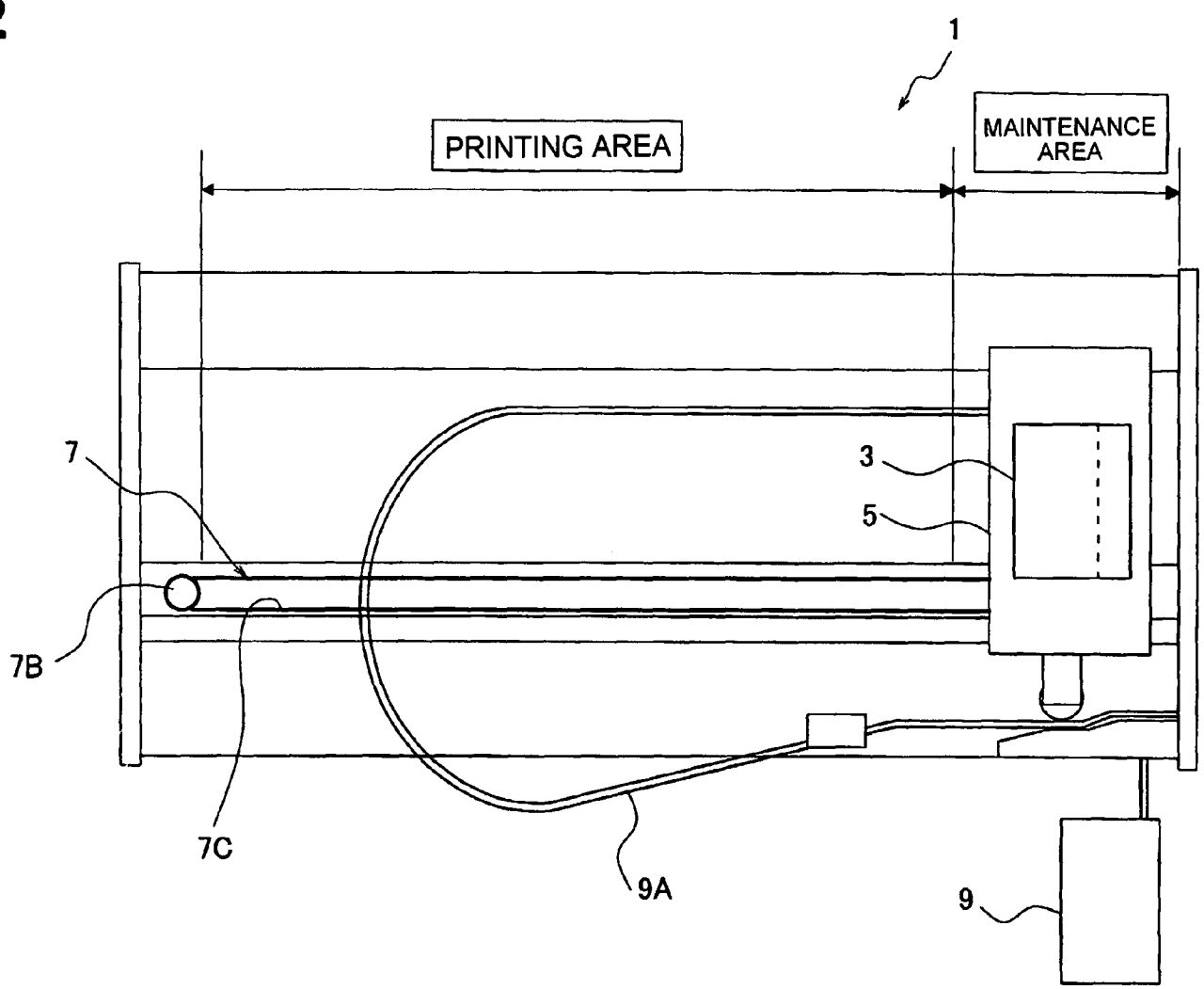
FIG. 2 is a schematic diagram of a main part (printer engine unit) of the inkjet printer according to the embodiment of the present invention.

To form an image on the sheet, the carriage 5 (recording head 3) ejects ink onto a sheet while reciprocating in a printing area of a main scanning area (see FIG. 1) in step with a sheet conveying operation. On the other hand, when image formation is not being carried out, including when a vacuum purging operation is executed as described below, the carriage 5 is in a standby state in a maintenance area of the main scanning area (see FIG. 2).

Further, the recording head 3 and the ink tank 9 are connected through a flexible tube 9A, and a pumping unit, such as a tube pump (not shown), pumps ink out of the ink tank 9 and supplies the ink to the recording head 3.

A purging device 10, for use during the vacuum purging operation, and a wiper 20, for wiping the nozzle surface 3A after the vacuum purging operation, are provided in the maintenance area. The purging device 10 will be described next.

Figure 4:
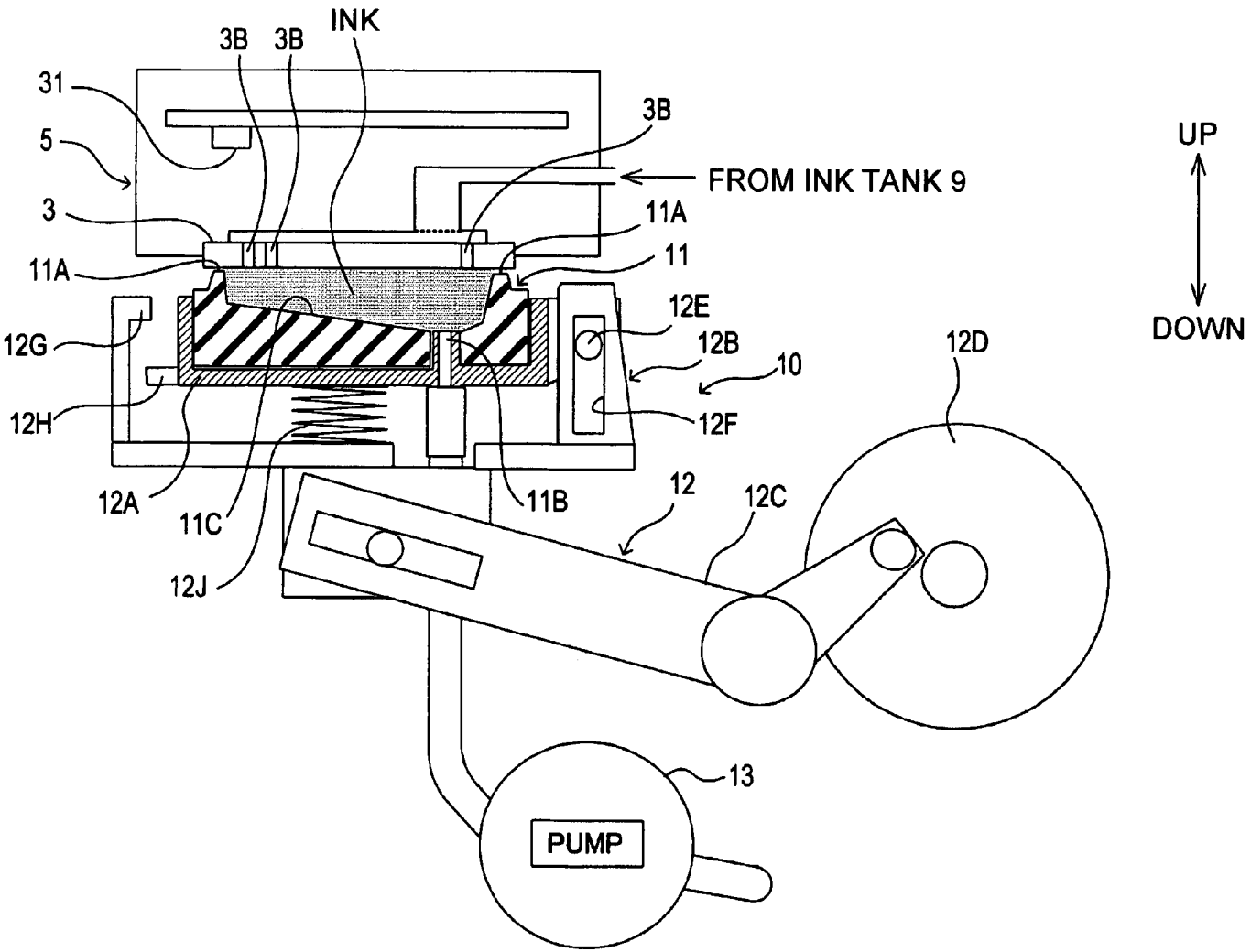
FIG. 4 shows operations of a nozzle cap and a purging device according to the embodiment of the present invention.

As shown in FIG. 4, the purging device 10 includes a nozzle cap 11 that comes into contact with the nozzle surface 3A from below in an upward direction during the vacuum purging operation so as to cover all the nozzles 3B, a cap actuator 12 for bringing the nozzle cap 11 close to/away from the nozzle surface 3A, a suction pump 13 for sucking out air from the nozzle cap 11, and a controller 30 (see FIG. 9) for controlling operations of the cap actuator 12.

The nozzle cap 11 has a recess 11C that is concaved in a direction away from the nozzle surface 3A. An exhaust port 11B is formed at the bottom of the recess 11C to communicate with the suction side of the suction pump 13. A sealing surface 11A is formed around the recess 11C (periphery), which is brought into contact with the nozzle surface 3A in a liquid tight manner so as to enclose the nozzles 3B.

In this embodiment, the nozzle cap 11 (particularly the sealing surface 11A) is made of an elastically deformable material, such as butyl rubber, so that it is able to securely seal ink with the sealing surface 11A.

The cap actuator 12 includes a cap holder 12A integrated with the nozzle cap 11, a holder drive plate 12B coupled with the cap holder 12A, a linkage 12C for moving the holder drive plate 12B vertically to bring the holder drive plate 12B close to/away from the nozzle surface 3A, and a cam 12D for driving the linkage 12C. The cam 12D is rotated by an electric motor 12K (see FIG. 9).

Further, a connection portion 12E provided at one of horizontal ends of the cap holder 12A (right end in FIG. 4) is pivotably connected to the holder drive plate 12B. The connection portion 12E can move along a cam groove 12F that is formed in the holder drive plate 12B and extends in the movement direction (vertical direction) of the nozzle cap 11.

On the other hand, a stopper 12G is provided opposite the connection portion 12E across the cap holder 12A on the holder drive plate 12B to prevent the cap holder 12A from shifting with respect to the holder drive plate 12B beyond a preset dimension in the movement direction (vertical direction) of the nozzle cap 11. The cap holder 12A has a projection 12H that comes into contact with the stopper 12G.

Further, a coil spring 12J is provided between the cap holder 12A and the holder drive plate 12B as an elastic unit for imparting the cap holder 12A with an elastic force for pressing the nozzle cap 11 against the nozzle surface 3A.

2. Schematic Electric Configuration of Controller etc. (See FIG. 9)

Figure 9:
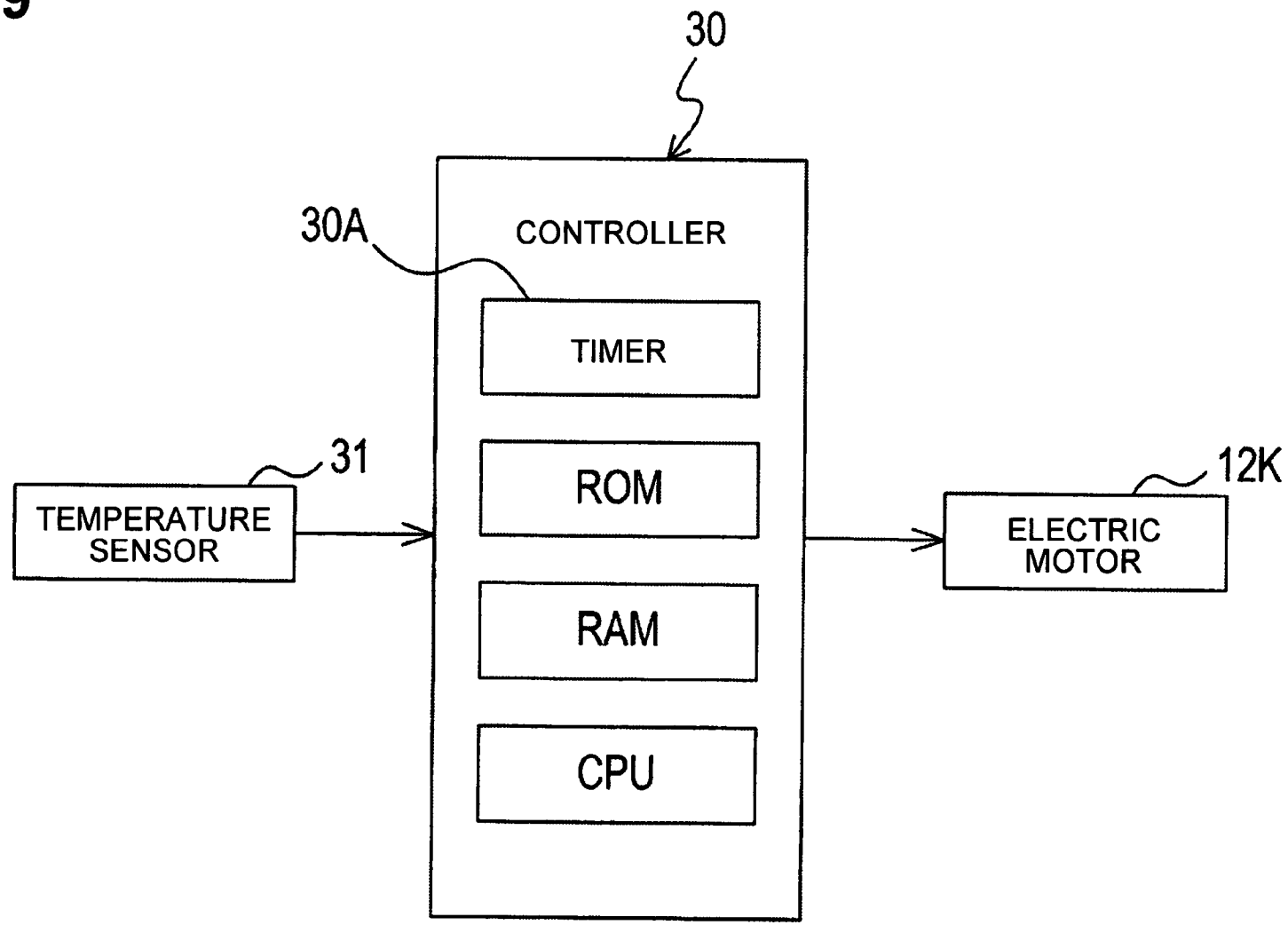
FIG. 9 is a block diagram schematically showing an electrical configuration of a controller or the like according to the embodiment of the present invention.

As shown in FIG. 9, the controller 30 for controlling operations of the purging device 10 (electric motor 12K) includes a timer 30A for measuring time, a memory such as a RAM or a ROM, and a general microcomputer including a CPU. Output data of a temperature sensor 31 such as a thermistor for detecting an ambient temperature of the printer engine unit 1 (particularly the carriage 5) is input to the controller 30. In this embodiment, the temperature sensor 31 is incorporated into the carriage 5.

Further, in this embodiment, a temperature of ink ejected from the recording head 3 is estimated on the basis of a temperature detected with the temperature sensor 31, and the estimated ink temperature is utilized to control a nozzle cap detaching step.

3. Operation of Purging Device (See FIGS. 4 to 8)

As described above, the vacuum purging operation is an operation of removing air bubbles or foreign material clogging the nozzle 3B using a negative pressure. In this embodiment, this operation is executed in response to a user's instruction sent to an inkjet printer, for example.

The controller 30 controls operations of the purging device 10 following a control flow of FIG. 10 in accordance with a program prestored in the ROM and the ink temperature estimated on the basis of a temperature detected with the temperature sensor 31 (hereinafter simply referred to as "ink temperature").

Figure 10:
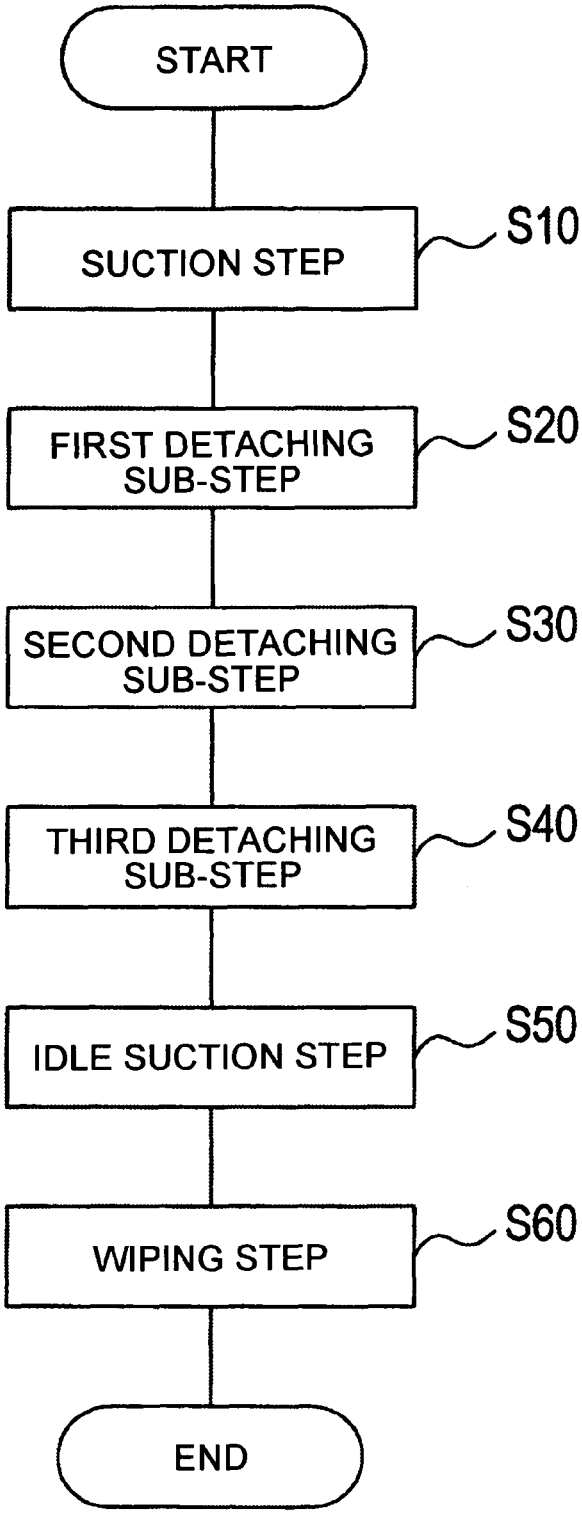
FIG. 10 is a flowchart of a vacuum purging operation according to the embodiment of the present invention.

If an instruction to execute the vacuum purging operation is issued to the inkjet printer, the control flow of the vacuum purging operation as shown in FIG. 10 is started. First, a suction step (S10) is carried out. Next, a first detaching sub-step (S20), a second detaching sub-step (S30), and a third detaching sub-step (S40) are performed in this order as the nozzle cap detaching step. After that, an idle suction step (S50) of removing residual ink from the nozzle cap 11 and a wiping step (S60) of wiping the nozzle surface 3A with the wiper 20 are performed in order to complete the vacuum purging operation.

The nozzle surface 3A is covered with the nozzle cap 11 at all times except for after the completion of the vacuum purging operation, during the vacuum purging operation, and during the printing operation. This is done to prevent ink from drying and foreign materials or the like from adhering to the nozzle surface 3A.

Each of the above steps is described next.

3.1. Suction Step (See FIG. 4)

The controller 30 rotates the cam 12D (via electric motor 12K) to bring the cap holder 12A near the nozzle surface 3A and to bring the sealing surface 11A into contact with the nozzle surface 3A. Then, the controller 30 drives the suction pump 13.

As a result, the sealing surface 11A of the nozzle cap 11 is pressed by the nozzle surface 3A. At this time, all the nozzles 3B are covered with the nozzle cap 11, thus the internal pressure of the nozzle cap 11 becomes a negative pressure (lower than an ambient pressure). As a result of this negative pressure, air bubbles or foreign materials remaining around the nozzles 3B are ejected into the nozzle cap 11 together with ink. In this way, the air bubbles or foreign materials clogging the nozzles 3B are removed.

3.2. Nozzle Cap Detaching Step

The nozzle cap detaching step is a step for detaching the nozzle cap 11 from the nozzle 3B after the suction step. In this embodiment, the step includes the three sub-steps: the first detaching sub-step (S20), the second detaching sub-step (S30), and the third detaching sub-step (S40). These three sub-steps are executed by the controller 30 controlling the cam 12D (via electric motor 12K).

3.2.1. First Detaching Sub-Step

Figure 11:
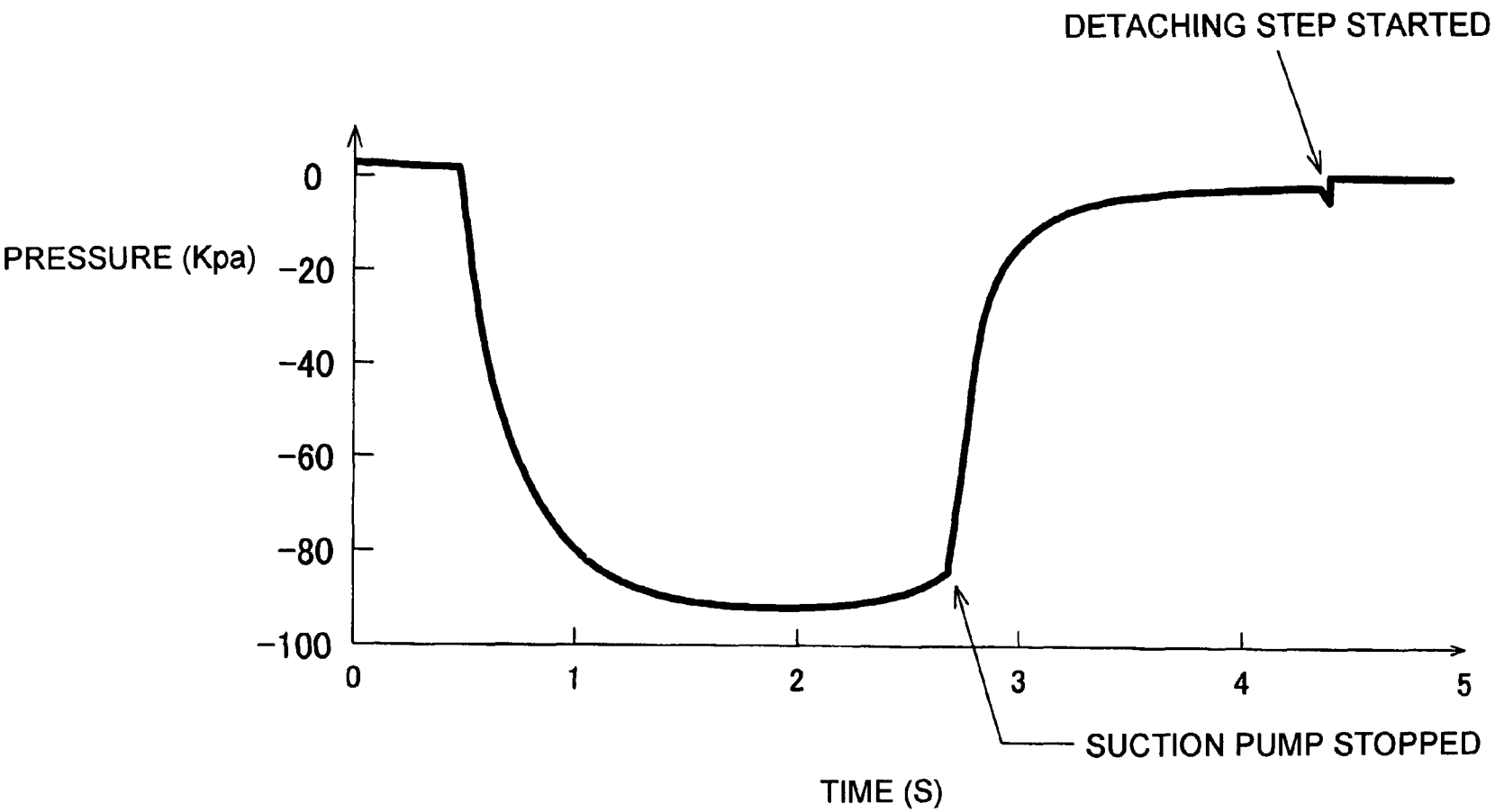
FIG. 11 is a graph showing a change in internal pressure of the nozzle cap according to the embodiment of the present invention.

The first detaching sub-step is performed when the suction pump 13 stops operation and an internal pressure of the nozzle cap 11 becomes equal to or higher than a predetermined pressure that is lower than the ambient pressure (see FIG. 11).

Then, the controller 30 determines a first predetermined distance L1 and a first predetermined time on the basis of a map or an equation prestored in the ROM and representing a relationship among the ink temperature, the first predetermined distance L1, and the first predetermined time. The first predetermined distance L1 and the first predetermined time are preset by means of experiment at a development stage.

Figure 5:
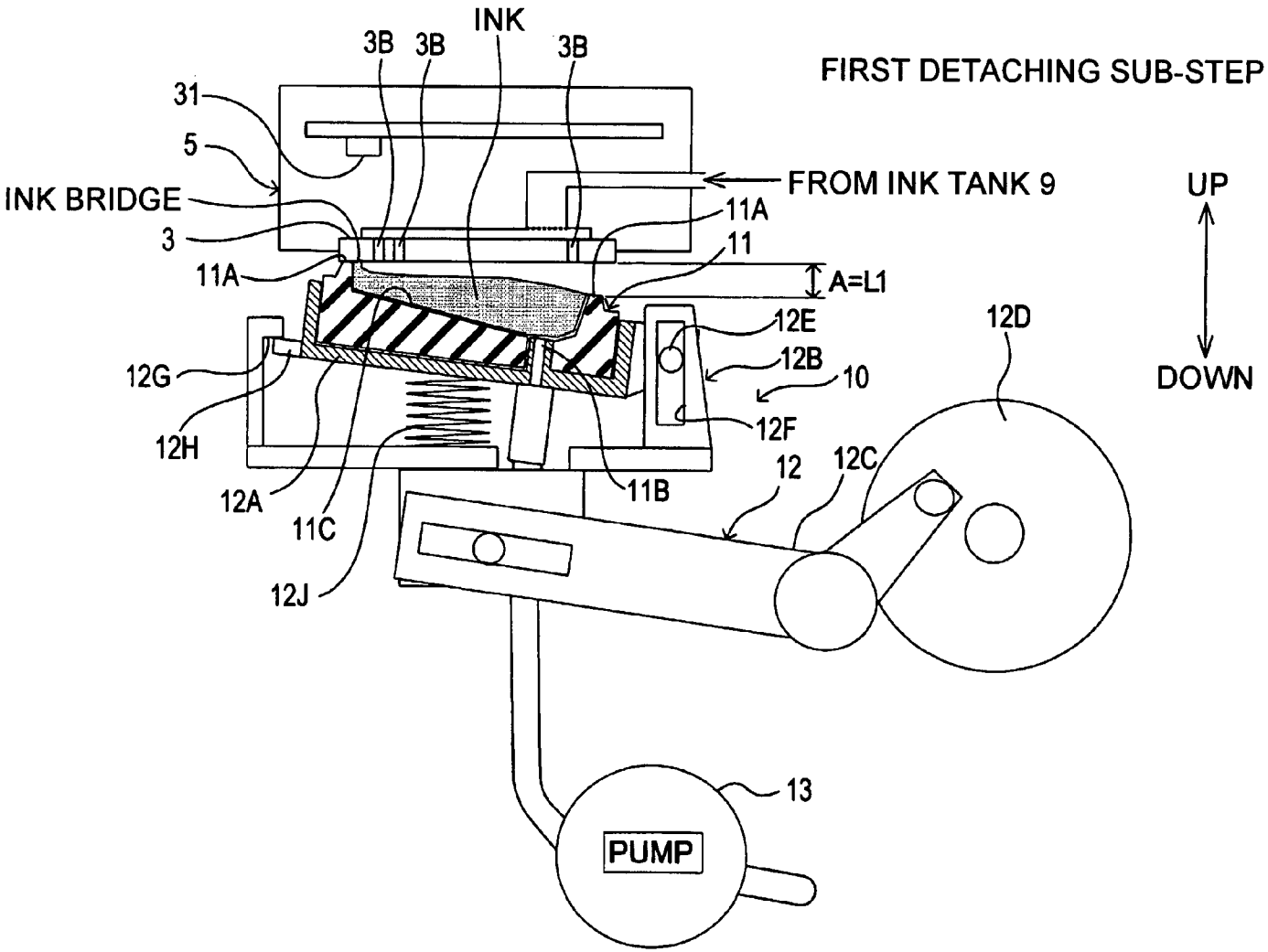
FIG. 5 shows operations of a nozzle cap and a purging device according to the embodiment of the present invention.

Next, the controller 30 rotates the cam 12D (via electric motor 12K) so as to detach the nozzle cap 11 from the nozzle surface 3A as follows. The sealing surface 11A, which is entirely in contact with the nozzle surface 3A (see FIG. 4), is moved such that one end (left end in FIG. 5) of the sealing surface 11A remains in contact with the nozzle surface 3A while the other end (right end in FIG. 5) of the sealing surface 11A is moved away from the nozzle surface 3A, as shown in FIG. 5.

That is, the controller 30 detaches the nozzle cap 11 from the nozzle surface 3A such that the sealing surface 11A is inclined with respect to the nozzle surface 3A while one end of the sealing surface 11A is in contact with the nozzle surface 3A. Here, the term "while one end of the sealing surface 11A is in contact with the nozzle surface" means not only a state in which one end is in contact with the nozzle surface 3A but also a state in which one end is in close proximity to the nozzle surface 3A with a small distance therebetween.

At this time, one end (left end in FIG. 5) of the sealing surface 11A (hereinafter referred to as "contact portion") is in contact with the nozzle surface 3A outside the nozzles 3B in this embodiment. The other end (right end in FIG. 5) of the sealing surface 11A is hereinafter referred to as "separate portion".

Then, the controller 30 stops rotation of the cam 12D (via electric motor 12K) at least for the first predetermined time after a distance A from the separate portion of the sealing surface 11A to the nozzle surface 3A becomes equal to the first predetermined distance L1. Accordingly, the contact portion of the sealing surface 11A remains in contact with the nozzle surface 3A. This position, where the distance A is equal to the first predetermined distance L1 and the contact portion of the sealing surface 11 remains in contact with the nozzle surface 3A, is maintained for at least the first predetermined time.

3.2.2. Second Detaching Sub-Step

The controller 30 determines whether or not the first detaching sub-step is completed, that is, whether or not the first predetermined time has elapsed after the distance A became equal to the first predetermined distance L1 while the contact portion of the sealing surface 11A was in contact with the nozzle surface 11A. To accomplish this, the controller 30 determines whether or not the first predetermined time has elapsed on the basis of time measured with the timer 30A from the time when the cam 12D (electric motor 12K) was stopped to rotate in the first detaching sub-step.

Then, after having determined that the first detaching sub-step is completed, the controller 30 determines a second predetermined distance L2 and a second predetermined time on the basis of a map or an equation prestored in the ROM. This map or equation represents a relationship among the ink temperature, the second predetermined distance L2, and the second predetermined time. The second predetermined distance L2 and the second predetermined time are preset by means of experiment at a development stage.

Figure 6:
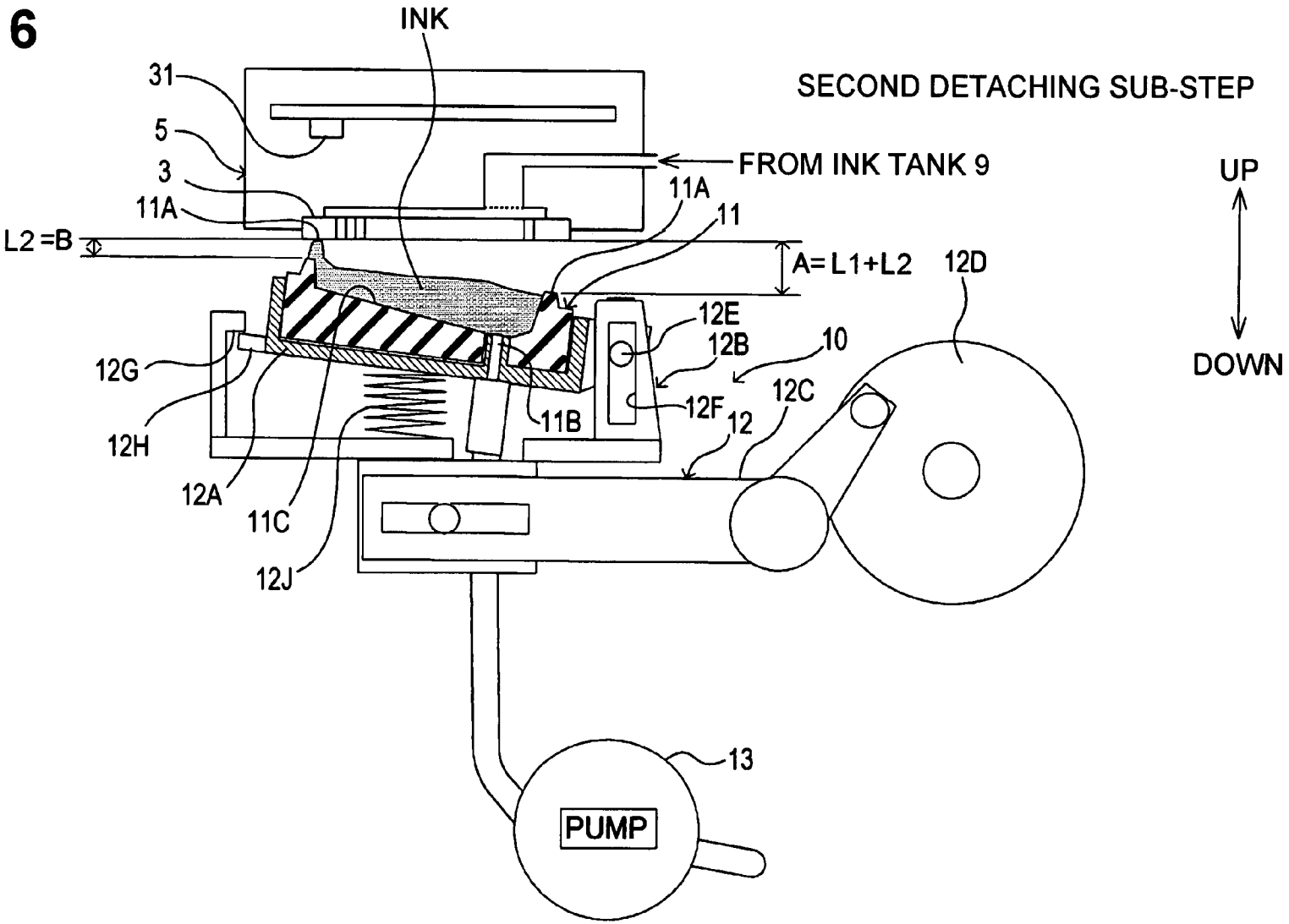
FIG. 6 shows operations of a nozzle cap and a purging device according to the embodiment of the present invention.
Figure 7:
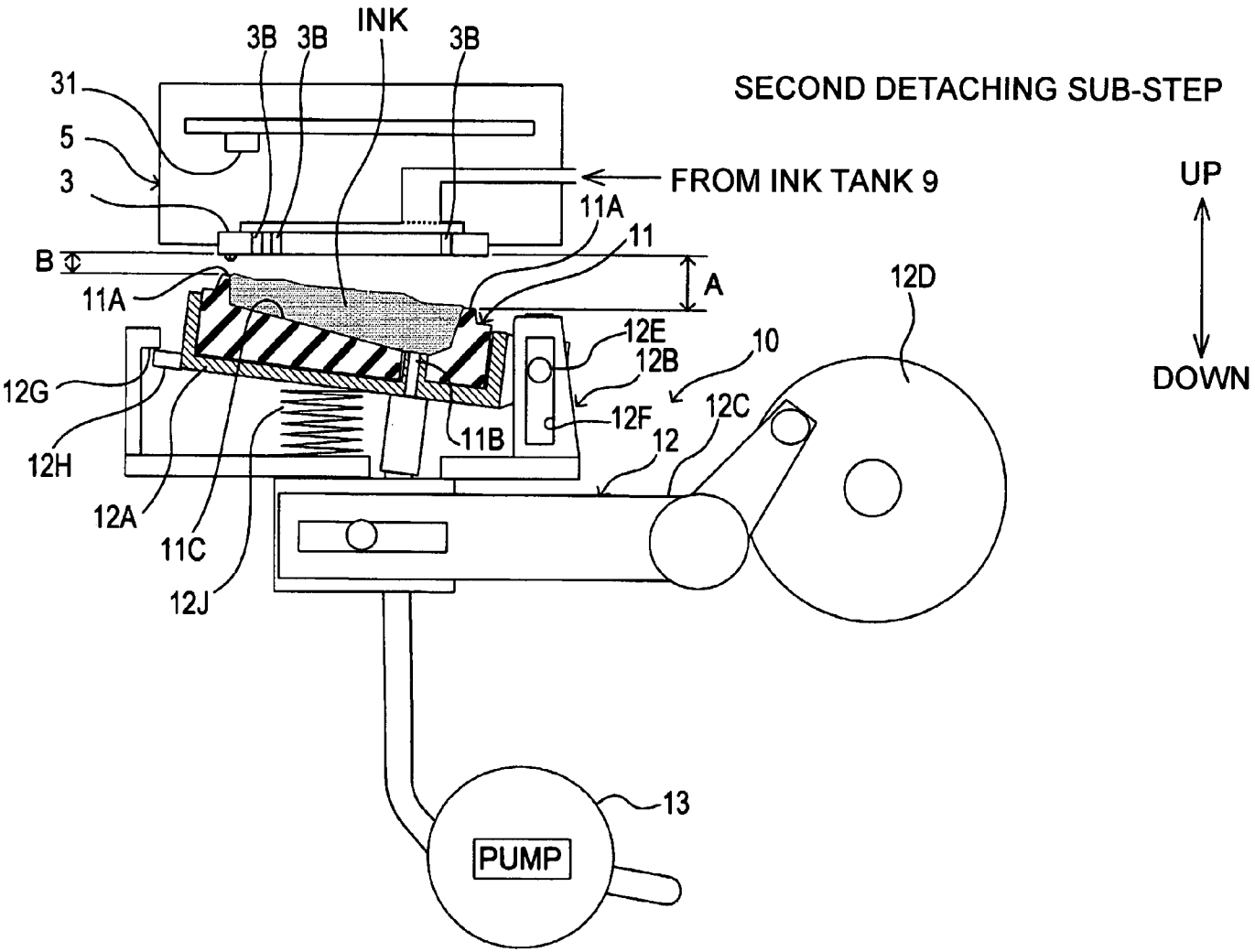
FIG. 7 shows operations of a nozzle cap and a purging device according to the embodiment of the present invention.

Next, as shown in FIG. 6, the controller 30 detaches the nozzle cap 11 from the nozzle surface 3A such that a distance B from the contact portion of the sealing surface 11A to the nozzle surface 3A becomes equal to the second predetermined distance L2. In this way, the entire sealing surface 11A is positioned further from the nozzle surface 3A than in the first detaching sub-step. In addition, the controller keeps the detached state at least for the second predetermined time.

3.2.3. Third Detaching Sub-Step

The controller 30 determines whether or not the second detaching sub-step is completed, that is, whether or not the second predetermined time has elapsed after (1) the distance B from the contact portion of the sealing surface 11A to the nozzle surface 3A became equal to a second predetermined distance L2 and (2) the distance A from the separate portion of the sealing surface 11A to the nozzle surface 3A was equal to the sum of the first predetermined distance L1 and the second predetermined distance L2.

To accomplish this, the controller 30 determines whether or not the second predetermined time has elapsed on the basis of time measured with the timer 30A from when the cam 12D (electric motor 12K) was stopped to rotate in the second detaching sub-step.

Figure 8:
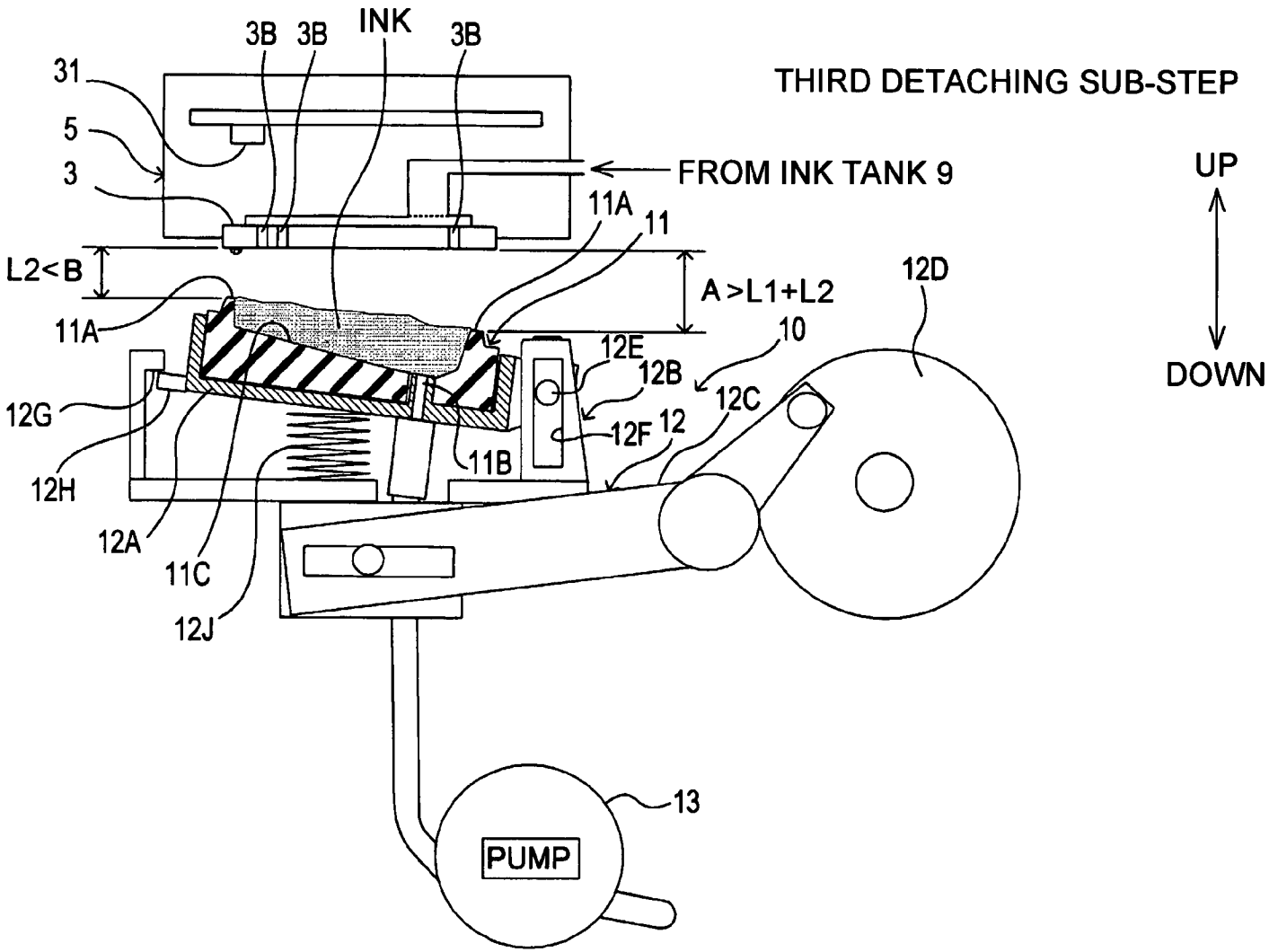
FIG. 8 shows operations of a nozzle cap and a purging device according to the embodiment of the present invention.

Then, after having determined that the second detaching sub-step is completed, the controller 30 detaches (moves) the nozzle cap 11 further from the nozzle surface 3A such that the distance B from the contact portion of the sealing surface 11A to the nozzle surface 3A is larger than the second predetermined distance L2 and the distance A from the separate portion of the sealing surface 11A to the nozzle surface 3A is larger than the sum of the first predetermined distance L1 and the second predetermined distance L2 (see FIG. 8). Finally, the controller 30 stops moving the nozzle cap 11 away from the nozzle surface 3A, thereby completing the vacuum purging operation.

4. The Ink Bridge

In the first detaching sub-step, when the nozzle cap 11 is detached from the nozzle surface 3A such that the contact portion of the sealing surface 11A is in contact with the nozzle surface 3A and the distance A from the separate portion of the sealing surface 11A to the nozzle surface 3A is equal to the first predetermined distance L1, residual ink spreading over the nozzle surface 3A is formed into an ink bridge. This ink bridge is gradually moved from the separate portion of the sealing surface 11A to the contact portion of the sealing surface 11A, as shown in FIG. 5.

Then, the controller stops moving the nozzle cap 11 and keeps this state for a period of time necessary to complete the movement of the ink bridge (first predetermined time) prior to the second detaching sub-step, so the ink bridge finally converges at the contact portion of the sealing surface 11A.

Next, in the second detaching sub-step, the controller detaches the nozzle cap 11 from the nozzle surface 3A such that the distance B from the contact portion of the sealing surface 11A to the nozzle surface 3A is equal to the second predetermined distance L2 and keeps this state. Then, the ink bridge converged at the contact portion in the first detaching sub-step is extended in the detaching direction and thus cut (see FIG. 7).

At this time, in this embodiment, the controller stops moving the nozzle cap 11 and keeps this state for a period necessary to cut the ink bridge (second predetermined time). Thus, as compared with the inkjet printer, in which an ink bridge is cut while the nozzle cap 11 is moving, the ink bridge can be securely cut on the nozzle surface 3A side to avoid such a situation that a large amount of ink containing air bubbles or foreign materials remains on the nozzle surface 3A.

Therefore, in this embodiment, it is possible to suppress occurrences of certain problems. For example, that ink containing air bubbles or foreign materials, which remains on the nozzle surface 3A, is prevented from flowing back to the nozzle 3B and causing color mixture or an ejection error.

For another example, a problem of spattering a large amount of ink in the wiping step (S60) can be overcome.

If the first predetermined distance L1 is too small, the sealing surface 11A is made to be to close to the nozzle surface 3A. As a result, the sealing surface 11A becomes substantially parallel to the nozzle surface 3A. In this case, the ink bridge between the nozzle surface 3A and the nozzle cap 11 extends over the nozzle surface 3A and cannot be easily moved to (converge at) the contact portion of the sealing surface 11A.

On the other hand, if the first predetermined distance L1 is excessively large, the ink bridge between the nozzle surface 3A and the nozzle cap 11 is cut before being moved to (concentrated on) the contact portion. In this case, ink droplets are more likely to spatter over the nozzle surface 3A.

To avoid the above, it is necessary to appropriately set the first predetermined distance L1. However, an appropriate value of the first predetermined distance L1 varies greatly depending on physical properties of ink such as ink temperature and ink viscosity.

To that end, in this embodiment, a relationship among the temperature of target ink, the first predetermined distance L1, and the first predetermined time is determined in advance by means of experiment, and information about the determined relationship between the ink temperature, the first predetermined distance L1, and the first predetermined time is stored in the ROM. Then, the first predetermined distance L1 and the first predetermined time are determined on the basis of the information stored in the ROM.

Likewise, the second predetermined distance L2 and the second predetermined time vary greatly depending on physical properties of ink, such as ink temperature and ink viscosity. In this embodiment, a relationship among the temperature of target ink, the second predetermined distance L2, and the second predetermined time is determined in advance by means of experiment, and information about the determined relationship is stored in the ROM. Then, the second predetermined distance L2 and the second predetermined time are determined on the basis of the information stored in the ROM.

As described above, in this embodiment, the first predetermined distance and the first predetermined time, and the second predetermined distance and the second predetermined time are determined in accordance with the ink temperature. This reliably prevents a large amount of ink containing air bubbles or foreign materials from remaining on the nozzle surface 3A regardless of the environment surrounding the inkjet printer.

As is understood from the above description, the second predetermined distance is set to such a distance as to cut an ink bridge extending from the contact portion of the sealing surface 11A to the nozzle surface 3A when the nozzle cap 11 is stopped (i.e., not moving). Thus, it is possible to prevent a situation in which the ink bridge is cut when the nozzle cap 11 is being detached (i.e., moving) from the nozzle surface 3A.

Further, in this embodiment, the third detaching sub-step is inserted after the second detaching sub-step, and further increases the distance between the contact portion of the sealing surface 11A and the nozzle surface 3A. Thus, should the ink bridge fail to be cut upon the completion of the second detaching sub-step, the ink bridge will be securely cut during the third detaching sub-step.

Further, in the above embodiment, the idle suction step (S50) and the wiping step (S60) are successively performed after the vacuum purging operation. However, a flushing operation (for ejecting ink from the nozzles to clean the nozzles) may be performed before the wiping step. In this case, an amount of ink ejected during the flushing operation can be reduced because the nozzle surface is free from a large amount of ink containing air bubbles or foreign materials. However, one or both of the idle suction step and the wiping step may be skipped.

Further, in the above embodiment, the first detaching sub-step is executed when the suction pump 13 stops operating and an internal pressure of the nozzle cap 11 becomes equal to or higher than a predetermined pressure that is below the ambient pressure, but the present invention is not limited thereto. For example, the first detaching sub-step may be executed before the suction pump 13 stops operating or when an internal pressure of the nozzle cap 11 becomes equal to the ambient pressure.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

What is claimed is:

1. An inkjet printer comprising:

a recording head including a nozzle surface with nozzles for ejecting ink;

a nozzle cap having a sealing surface that comes into contact with the nozzle surface of the recording head;

a cap actuator that operates to moves the nozzle cap both toward and away from the nozzle surface;

a controller that controls the operation of the cap actuator; and a suction pump that operates to decrease an internal pressure of the nozzle cap when the nozzles are covered with the nozzle cap, wherein the controller executes steps including:

a first detaching step including:

moving the nozzle cap from a starting state, where the sealing surface is entirely in contact with the nozzle surface, to a first state, where a first end of the sealing surface is either in physical contact with or separated by a minute distance from the nozzle surface and a second end of the sealing surface is separated from the nozzle surface by a first predetermined distance; and maintaining the nozzle cap in the first state for a first predetermined time; and a second detaching step including:

moving the nozzle cap from the first state to a second state, where the first end of the sealing surface is separated from the nozzle surface by a second predetermined distance which is greater than the minute distance and the second end is separated from the nozzle surface by a distance greater than the first predetermined distance; and maintaining the nozzle cap in the second state for a second predetermined time;

wherein the minute distance is defined as any distance that can indefinitely sustain an ink bridge between the first end of the sealing surface and the nozzle surface.

2. The inkjet printer according to claim 1;

wherein the first end of the sealing surface is in physical contact with the nozzle surface in the first detaching step.

3. The inkjet printer according to claim 1;

wherein the steps the controller executes further include:

a third detaching step including:

moving the nozzle cap from the second state to a third state, where the first end of the sealing surface is separated from the nozzle surface by a distance greater than the second predetermined distance and the second end is separated from the nozzle surface by a distance greater than the combined distances of the first predetermined distance and the second predetermined distance; and stopping the movement of the nozzle cap.

4. The inkjet printer according to claim 1;

wherein the controller includes a timer that measures time; and wherein the controller determines whether or not the first predetermined time has elapsed based on the time measured by the timer.

5. The inkjet printer according to claim 4;

wherein the controller determines whether or not the second predetermined time has elapsed based on the time measured by the timer.

6. The inkjet printer according to claim 1;

wherein, after the suction pump stops operating, the controller executes the first detaching step when an internal pressure of the nozzle cap becomes equal to or higher than a predetermined pressure, the predetermined pressure being below an ambient pressure.

7. The inkjet printer according to claim 1, further comprising:

a temperature detecting unit that detects a temperature of ink ejected from the nozzles, wherein the controller determines at least one of the first predetermined distance and the first predetermined time based on the temperature detected by the temperature detecting unit.

8. The inkjet printer according claim 1, further comprising:

a temperature detecting unit that detects a temperature of ink ejected from the nozzles, wherein the controller determines at least one of the second predetermined distance and the second predetermined time based on the temperature detected by the temperature detecting unit.

9. The inkjet printer according to claim 1;

wherein the second predetermined distance is set such that ink bridging from the first end of the sealing surface to the nozzle surface is cut while the nozzle cap is maintained in the second state for the second predetermined time.

10. A purging method for an inkjet printer comprising:

covering a nozzle surface of a recording head of an inkjet printer with a sealing surface of a nozzle cap;

decreasing an internal pressure of the nozzle cap with a suction pump;

a first detaching step including:

moving the nozzle cap from a starting state, where the sealing surface is entirely in contact with the nozzle surface, to a first state, where a first end of the sealing surface is either in physical contact with or separated by a minute distance from the nozzle surface and a second end of the sealing surface is separated from the nozzle surface by a first predetermined distance; and maintaining the nozzle cap in the first state for a first predetermined time; and a second detaching step including:

moving the nozzle cap from the first state to a second state, where the first end of the sealing surface is separated from the nozzle surface by a second predetermined distance which is greater than the minute distance and the second end is separated from the nozzle surface by a distance greater than the first predetermined distance; and maintaining the nozzle cap in the second state for a second predetermined time;

wherein the minute distance is defined as any distance that can indefinitely sustain an ink bridge between the first end of the sealing surface and the nozzle surface.

11. The method according to claim 10;

wherein the first end of the sealing surface is in physical contact with the nozzle surface in the first detaching step.

12. The method according to claim 10, further comprising:

a third detaching step including:

moving the nozzle cap from the second state to a third state, where the first end of the sealing surface is separated from the nozzle surface by a distance greater than the second predetermined distance and the second end is separated from the nozzle surface by a distance greater than the combined distances of the first predetermined distance and the second predetermined distance; and stopping the movement of the nozzle cap.

* * * * *